United States Patent [19]
Weaver
[11] 4,260,151
[45] Apr. 7, 1981

[54] GOLF GREEN SLOPE INDICATING DEVICE

[76] Inventor: Harold J. Weaver, 229 S. Seward Ave., Auburn, N.Y. 13021

[21] Appl. No.: 50,464

[22] Filed: Jun. 20, 1979

[51] Int. Cl.³ ..... A63B 57/00
[52] U.S. Cl. ..... 273/32 H; 33/283
[58] Field of Search ..... 273/32 H, 32 R; 33/283, 33/228, 391, 285

[56] References Cited

U.S. PATENT DOCUMENTS

| | | | |
|---|---|---|---|
| 994,521 | 6/1911 | Jacobs | 33/283 |
| 1,301,925 | 4/1919 | Farthing | 33/391 |
| 3,293,755 | 12/1966 | Cronwell | 273/32 H X |
| 3,308,541 | 3/1967 | Sponder | 33/228 |

FOREIGN PATENT DOCUMENTS

| | | | |
|---|---|---|---|
| 1231876 | 4/1960 | France | 33/391 |

*Primary Examiner*—George J. Marlo
*Attorney, Agent, or Firm*—Bruns & Jenney

[57] ABSTRACT

A hand held sighting device for golfers, particularly for use in determining correct putting directions on sloping putting greens. The device is a box-like, transparent receptacle in which a pointer is pivotally mounted. The lower end of the pointer is weighted so that it operates in the manner of a plumb bob. One of the sides of the receptacle has a central longitudinal line that passes through the pivot axis of the pointer and a plurality of transverse lines one of which also passes through the pivot axis of the pointer. In use, the golfer stands or kneels directly behind the ball facing the cup and sights through the device with his dominant eye. The eye of the golfer, the ball, the longitudinal line of the device and the cup must be brought into line, and one of the lower transverse lines must pass through the cup. The device is then tilted to the left or right to line up one of the upper transverse lines with the slope of the green and having done this the pointer will point in the direction that the ball should be propelled.

1 Claim, 5 Drawing Figures

GOLF GREEN SLOPE INDICATING DEVICE

BACKGROUND OF THE INVENTION

The present invention relates generally to the game of golf, and has particular reference to an improved sighting device for assisting players to determine correct putting directions on sloping putting greens.

As is well known to those acquainted with the game of golf, putting greens are rarely level, being intentionally sloped in most instances for drainage reasons. Because greens slope and roll and have subtle breaks, a golf ball lying on the green and putted directly towards the cup will seldom go in. Thus, depending on the direction and amount of slope, the ball usually must be aimed to the left or right of the cup in order to have the ball drop in.

To gauge the direction and degree of slope in a putting green, many golfers use the putter as a plumb bob sighting device by holding the handle at arm's length between thumb and forefinger whereby the club assumes a vertical position due to the weight of the club head. In addition to this method, a number of portable sighting devices have been developed for golfers and those known to the applicant are disclosed in U.S. Pat. Nos. 2,724,898; 3,293,755; 3,535,792 and 3,870,299.

Of these, U.S. No. Pat. 3,293,755 to Cronwell is believed to be the closest to the present invention in that it utilizes a pendulum pointer that operates as a plumb bob. To use the Cronwell device, however, it must first be laid flat on the green and aligned with the cup, then rolled upwardly to allow the pendulum to assume its gravity dictated position in which position it is locked, then rolled back down flat on the green where the pendulum points in the direction that the ball should be propelled.

Other related prior art developed in a preliminary search consists of U.S. Pat. Nos. 396,883 and 2,754,594 and Danish Pat. No. 15752 of Mar. 18, 1912.

SUMMARY OF THE INVENTION

The sighting device of the present invention is hand held and is particularly for use in determining correct putting directions on sloping greens although it can also be used as an aid in making approach shots. The device is a box-like, transparent receptacle that is dimensioned so that it fits easily in a shirt pocket. Pivotally mounted in the receptacle is a pointer the lower end of which is weighted so that it operates in the manner of a plumb bob. One of the sides of the receptacle has a central longitudinal (vertical) line and a plurality of transverse (horizontal) lines, the transverse lines being perpendicular to the longitudinal line. The longitudinal line and one of the transverse lines pass through pivot axis of the pointer.

In use, the golfer stands or squats directly behind the ball facing the cup and sights through the device with his dominant eye. The eye of the golfer, the ball, the longitudinal line of the device and the cup must be brought into line, and one of the lower transverse lines must pass through the cup. The device is then tilted to the left or right until one of the upper transverse lines registers with the slope of the green. The pointer will at that time point in the direction that the ball should take.

DESCRIPTION OF THE PREFERRED EMBODIMENT

Figure 5:
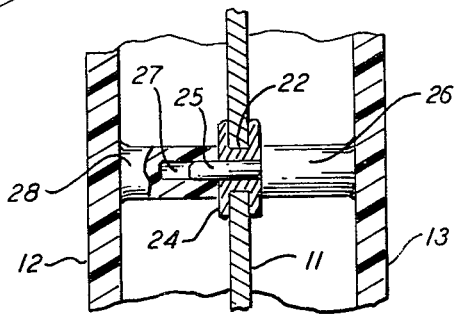
FIG. 5 is a further enlarged, detail view showing the pivotal mounting for the pointer.

Referring now to the drawings, and with particular reference to FIGS. 3–5, the sighting device essentially comprises a transparent box-like receptacle generally indicated at 10 and a pointer element 11 pivotally mounted in the receptacle as will be described in greater detail hereinafter. The receptacle 10 is preferably made of clear plastic and includes front and back sides 12 and 13, and top, bottom and side edges 15, 16 and 17. As indicated in FIG. 4, the back 13 and edges can be molded as a unit and the front plate 12 can be secured thereto as by screws 18. Alternatively, the front plate can be permanently secured in position by an adhesive or by ultrasonic welding.

The receptacle 10 is dimensioned so that the device will easily fit in a shirt pocket, the receptacle being approximately the same size as a pack of playing cards. The receptacle is shown as having a completely rectilinear configuration but this need not be as long as the front 12 is flat.

The pointer 11 is similar to a compass needle and is provided at its lower end 20 with a weight 21 so that the needle will act as a plummet or plumb bob. The pointer has a hole 22 approximately midway between its ends and this hole is occupied by a flanged bushing 24 about which the pointer can pivot freely. As best shown in FIG. 5, the bushing 24 is mounted with a press fit on a reduced diameter portion 25 of a post 26, and the reduced diameter portion that extends beyond the bushing is received in an axial bore 27 in an opposing post 28.

Figure 2:
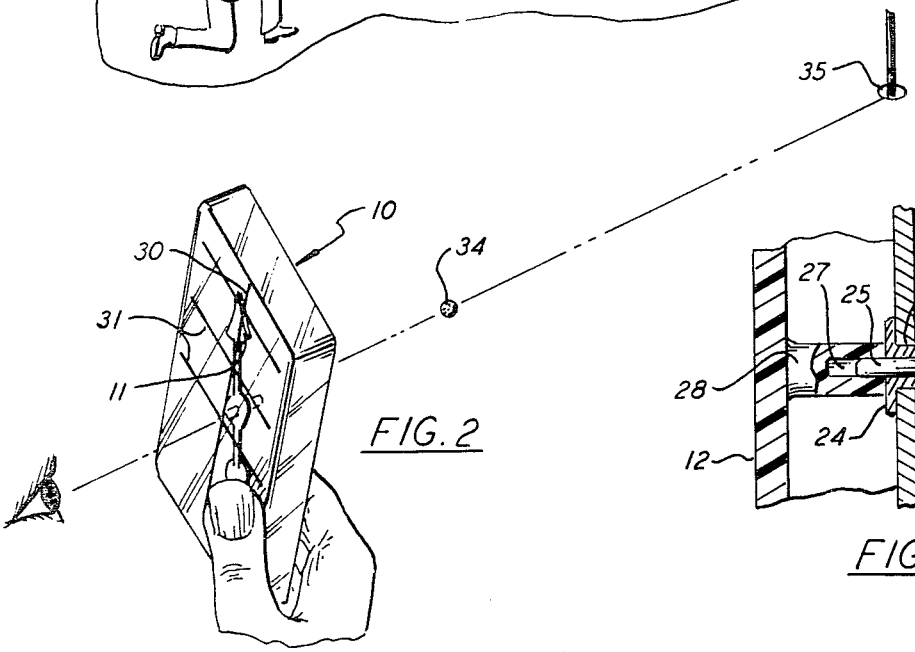
FIG. 2 is an enlarged diagrammatic view illustrating the manner of operation of the sighting device.
Figure 3:
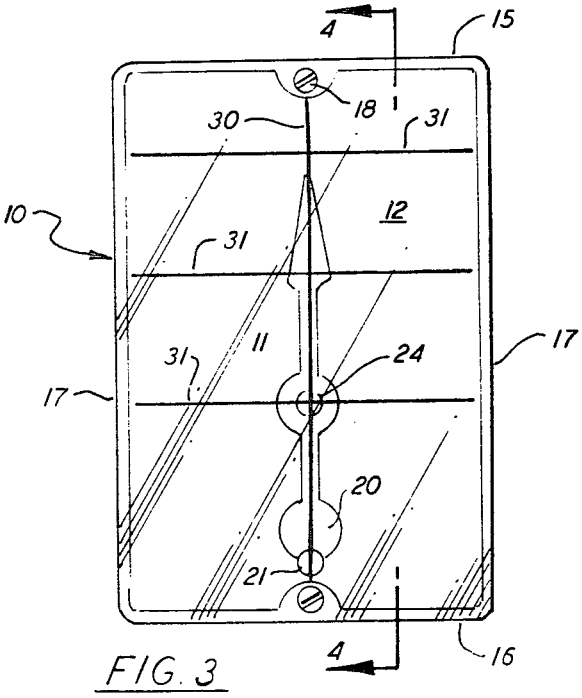
FIG. 3 is an enlarged front elevation of the device.
Figure 4:
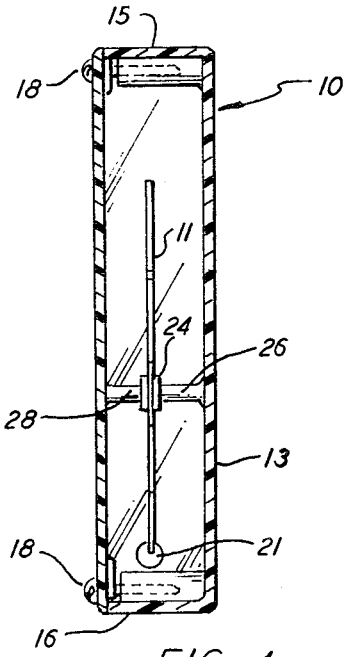
FIG. 4 is a vertical sectional view taken of line 4—4 of FIGS. 3.

As shown in FIGS. 2 and 3, the front side 12 of the receptacle has a central longitudinal line 30 and a plurality of transverse lines 31. These lines can be painted or etched on the front plate. Since the sighting device is held in an almost vertical position in use, line 30 may also be referred to as the vertical line and lines 31 as the horizontal lines, the latter all being perpendicular to the former. In this connection, it can be seen that the pivot point for pointer 11 coincides with the intersection of the line 30 and the lowermost line 31. The pivot point is thus centered between the side edges 17 of the receptacle but is below the midpoint of line 30.

Figure 1:
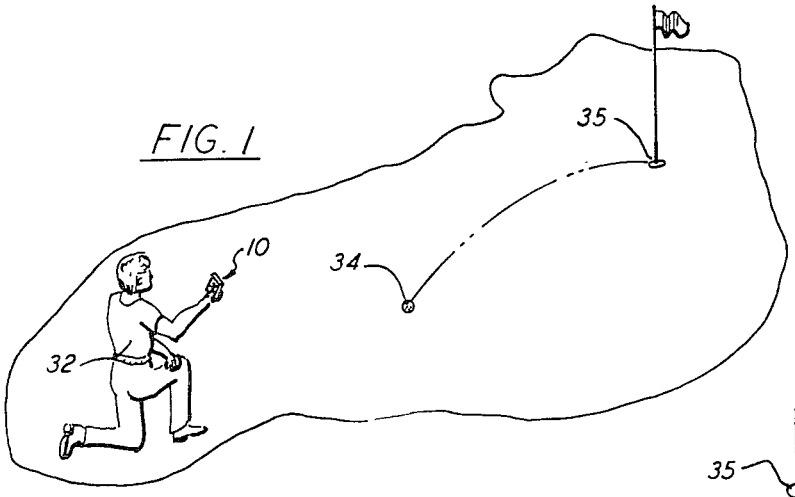
FIG. 1 is a perspective view illustrating a golfer using the sighting device of the invention.

To use the sighting device, FIGS. 1 and 2, the golfer 32 stands or kneels directly behind his ball 34 and sights through the receptacle 10 with his dominant eye which can be determined by a well known simple test. The golfer's eye, the ball, the vertical line 30 of the device and the cup 35 are brought into line, and the lower or middle horizontal line 31 is made to pass through the cup. The device is then tilted to the left or right to make the upper horizontal line 31 coincide with the slope of the green. When this has been done, the pointer 11 will point in the direction that the ball should take.

If the pointer points to the left of the cup, as indicated in FIG. 2, the putt will break from left to right as indicated in FIG. 1. If the pointer points to the right of the cup, the putt will break from right to left. If the pointer points right at the cup, slope is not a factor in the area of the green between the ball and cup, and the ball can be aimed right at the cup. When the pointer indicates that the ball should be aimed to the left or right of the cup, the golfer can pick a reference mark on the line of direction indicated by the pointer and hit the ball toward such mark with enough force to reach the cup.

The sighting device of the invention can even be used advantageously on putts of ten feet or less. Thus, the device can be used to scan the green near the hole by looking between the horizontal lines 31 and this may reveal subtle breaks. The device can also be used with somewhat less accuracy in making approach shots.

From the foregoing description, it will be apparent that the invention provides a sighting device that has a simple construction, is convenient to use and can materially assist a golfer in his putting. As will be understood by those familiar with the art, the invention may be embodied in other specific forms without departing from the spirit or essential characteristics thereof.

I claim:

1. A hand held golfer's sighting device for use when putting to indicate the direction of slope of a golf green comprising a hollow parallelepiped having transparent front and back walls connected in spaced relation to one another by top and bottom walls and a pair of side walls, and an elongated pointer element pivotally mounted in the device between the transparent front and back walls, the pointer element having a pivot axis located approximately midway between its ends, the device being adapted to be held in a generally upright position above the ground for sighting therethrough, the pointer being weighted at one end whereby it operates as a plumb bob within the device, the transparent front wall having an elongated longitudinal sight line and a plurality of spaced apart parallel transverse sight lines thereon, the longitudinal sight line passing through the pivot axis of the pointer element and said transverse sight lines being located between said pivot axis and the top wall of the device. Whereby the slope of the golf green and the direction that the ball should be putted is indicated by said pointer when at least one of said transverse lines is positioned to register with the slope of the green and the golf ball and the putting cup are sighted on and aligned with said longitudinal sight line.

* * * * *